US011305300B2

(12) United States Patent
Lin et al.

(10) Patent No.: US 11,305,300 B2
(45) Date of Patent: Apr. 19, 2022

(54) SWITCHING DEVICE AND TOP SHOWER

(71) Applicant: XIAMEN SOLEX HIGH-TECH INDUSTRIES CO., LTD., Xiamen (CN)

(72) Inventors: Fengde Lin, Xiamen (CN); Wenxing Chen, Xiamen (CN); Ruosheng Ning, Xiamen (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 279 days.

(21) Appl. No.: 16/412,124

(22) Filed: May 14, 2019

(65) Prior Publication Data

US 2019/0344292 A1 Nov. 14, 2019

(30) Foreign Application Priority Data

May 14, 2018 (CN) ..... 201810455239.6

(51) Int. Cl.
*B05B 1/18* (2006.01)
*B05B 12/00* (2018.01)

(52) U.S. Cl.
CPC ..... *B05B 1/185* (2013.01); *B05B 12/002* (2013.01)

(58) Field of Classification Search
CPC ..... B05B 1/185; B05B 1/1636; B05B 1/169; B05B 1/1681; B05B 1/12; B05B 1/1609; B05B 1/3026; B05B 1/16; B05B 1/14; B05B 1/1627; B05B 12/002–0026; B05B 1/18–22; Y10T 137/86863; E03C 1/0404; E03C 1/0405
USPC ..... 239/563
See application file for complete search history.

(56) References Cited

U.S. PATENT DOCUMENTS

2011/0192915 A1* 8/2011 Li ..... B05B 1/1609 239/394
2013/0214064 A1* 8/2013 Vorel ..... B05B 1/12 239/583
2016/0221006 A1* 8/2016 Lin ..... B05B 1/12

* cited by examiner

*Primary Examiner* — Darren W Gorman
*Assistant Examiner* — Juan C Barrera
(74) *Attorney, Agent, or Firm* — Cooper Legal Group, LLC

(57) ABSTRACT

Disclosed is a switching device, comprising: an operating member, a drive element, a sealing assembly and a water dividing member; the sealing assembly are disposed above the water dividing member and spaced arranged along the circumference of the water dividing member; the sealing assembly is disposed with a sealing unit corresponding to the water dividing hole of the water dividing member; the drive element is linked to the operating member, and the drive element is disposed with a transmission mechanism that is in driving engagement with the sealing unit; when the operating member drives the drive element to move, the transmission mechanism and the sealing assembly move relative to each other, when the transmission mechanism is moved to be engaged with the sealing unit, the sealing unit moves along the transmission direction generated by the transmission mechanism, making the sealing unit separated from the corresponding water dividing hole, and the water dividing hole is opened. The present invention provides an outlet water switching structure and a shower head equipped with the structure, and the sealing assembly moves up and down along the axial direction to achieve closing or opening of the water dividing hole.

14 Claims, 14 Drawing Sheets

SWITCHING DEVICE AND TOP SHOWER

TECHNICAL FIELD

The present invention relates to the field of the sanitary ware, and more particularly to a switching device.

RELATED ART

There are several ways to switch the water type of the head shower heads or rain shower heads with a ball head on the market:

1. Conventional cover rotation switching: requires two hands to operate.

2. Button switching: If the switching position is placed in the center of the ball head, the arm is easy to wet when the function is switched; if the switching position is far from the ball head, as the force position is parallel to the axis of the ball head, the cover is easy to swing when switching.

3. Back dial switch: The back dial can't be reset: the force position is perpendicular to the axis of the ball head, it is not easy to make the cover assembly swing. However, when the function is switched between the two extreme positions, as the operator can't see the dial, the reapplying force in one of the two extreme positions tends to loosen the thread at the ball head.

The above-mentioned water dividing methods are all rotated by a rotation plate, and the water type can combine N functions with only N mixed water functions. For some special water types, it is not suitable for mixed water, and the mixed water can not be realized. There are limitations, and the versatility is not good, people need to do specific design for the specific water type of different shower heads.

SUMMARY OF THE INVENTION

The main technical problem to be solved by the present invention is to provide an outlet water switching structure and a shower head equipped with the structure, and the sealing assembly moves up and down along the axial direction to achieve closing or opening of the water dividing hole.

In order to solve the above technical problem, the present invention provides a switching device, comprising: an operating member, a drive element, a sealing assembly and a water dividing member;

The sealing assembly is disposed above the water dividing member and spaced arranged along the circumference of the water dividing member; the sealing assembly is disposed with a sealing unit corresponding to the water dividing hole of the water dividing member; the drive element is linked to the operating member, and the drive element is disposed with a transmission mechanism that is in driving engagement with the sealing unit; when the operating member drives the drive element to move, the transmission mechanism and the sealing assembly move relative to each other, when the transmission mechanism moves to the sealing unit to be engaged with, the sealing unit moves along the transmission direction generated by the transmission mechanism, making the sealing unit separated from the corresponding water dividing hole, and the water dividing hole is opened.

In another preferred embodiment, the sealing unit is connected to a resetting member, when the transmission mechanism is moved to release the transmission cooperation with the sealing unit, the resetting member drives the sealing unit to move in the opposite direction of the transmission direction generated by the transmission mechanism, making the sealing unit abutted against the corresponding water dividing hole, and the water dividing hole is closed.

In another preferred embodiment, further comprising a fixing base for mounting the sealing unit, one side of the fixing base facing the water dividing member is disposed with accommodating cavities with the number corresponding to the sealing units, the sealing unit and the resetting member are disposed in the accommodating cavity, and the two ends of the resetting member respectively abut against the sealing unit and the cavity bottom of the accommodating cavity.

In another preferred embodiment, the inner diameter of the accommodating cavity is the same as the inner diameter of the water dividing hole; the sealing unit is disposed with a through hole that connects the accommodating cavity with the outside; when the sealing unit is separated from the water dividing hole, water flows into the accommodating cavity through the through hole.

In another preferred embodiment, the transmission mechanism is only matched with one sealing unit at any time, so that only one of the water dividing holes is open.

In another preferred embodiment, the transmission mechanism is a inclined surface and is disposed along a circumferential direction of the drive element; the sealing unit is disposed with a protrusion that abuts against the inclined surface;

The operating member drives the drive element to rotate about the axial direction, when the inclined surface is rotated to abut against the protrusion, the inclined surface drives the protrusion to move upwardly in the axial direction.

In another preferred embodiment, further comprising a water outlet body, the water outlet body is provided with mutually independent water outlet chambers, and each of the water outlet chambers is correspondingly connected with one of the water dividing holes.

In another preferred embodiment, further comprising a water outlet body, the water outlet body is provided with mutually independent water outlet chambers, and at least one water dividing hole is connected to at least two water outlet chambers, when the water dividing hole is opened, water flows into the at least two water outlet chambers connected to the water dividing hole to form mixed water type water.

In another preferred embodiment, the transmission mechanism is coupled with at least two sealing units at a certain time, so that at least two of the water dividing holes are open at the same time.

In another preferred embodiment, the transmission mechanism comprises an inclined surface and a horizontal surface connected to a highest point of the inclined surface, and is spaced disposed along a circumference of the drive element; the sealing unit is disposed with a protrusion that abuts against the inclined surface;

The operating member drives the drive element to rotate about the axial direction, when the inclined surface is rotated to abut against the protrusion, the inclined surface drives the protrusion to move upwardly along the axial direction; when the horizontal surface rotates to abut against the protrusion, the water dividing hole is kept open.

In another preferred embodiment, further comprising a water outlet body, the water outlet body is provided with mutually independent water outlet chambers, and each of the water outlet chambers is corresponding to one of the water dividing holes.

In another preferred embodiment, the operating member comprises a dial, a driving wheel, a driven wheel, and a rotating stop mechanism and a reset mechanism;

The operating member drives the driven wheel to rotate by the driving wheel, and the reset mechanism causes the driving wheel and the driven wheel to be unidirectionally coupled in one direction, and when the driving wheel is reset by the resetting force of the reset mechanism, the driven wheel and the driving wheel are unengaged;

The driven wheel is linked to the drive element.

In another preferred embodiment, the rotation stop mechanism is a pawl; the side wall of the driven wheel is provided with a ratchet; the reset mechanism is a spring, and when the dial is pulled, the spring is stretched by the tensile force to store an elastic restoring force.

The present invention further provides a showerhead characterized by being equipped with above mentioned switching device.

Compared with the prior art, the technical solution of the present invention is disposed with the following beneficial effects:

1. The showerhead provided by the present invention realizes cyclic switching by the dial, the force position is perpendicular to the axis of the ball head of the showerhead, the switching force is light, and the ball head does not swing when the function is switched. The direction of the dialing is the direction in which the ball thread is tightened. After the hand releases, the dial is reset to the initial position, and no misoperation occurs. This effectively solves the problem that the ball head is easy to swing and the hands are required to operate when the head shower function is switched.

2. The showerhead provided by the present invention adopts a sealing unit to divide water along the axial direction to divide water, and can realize any single function+any desired mixed water combination, and is disposed with good versatility.

DETAILED DESCRIPTION OF THE EMBODIMENTS

The present invention will be further described below in conjunction with the accompanying drawings and embodiments.

Embodiment 1

Figure 1:
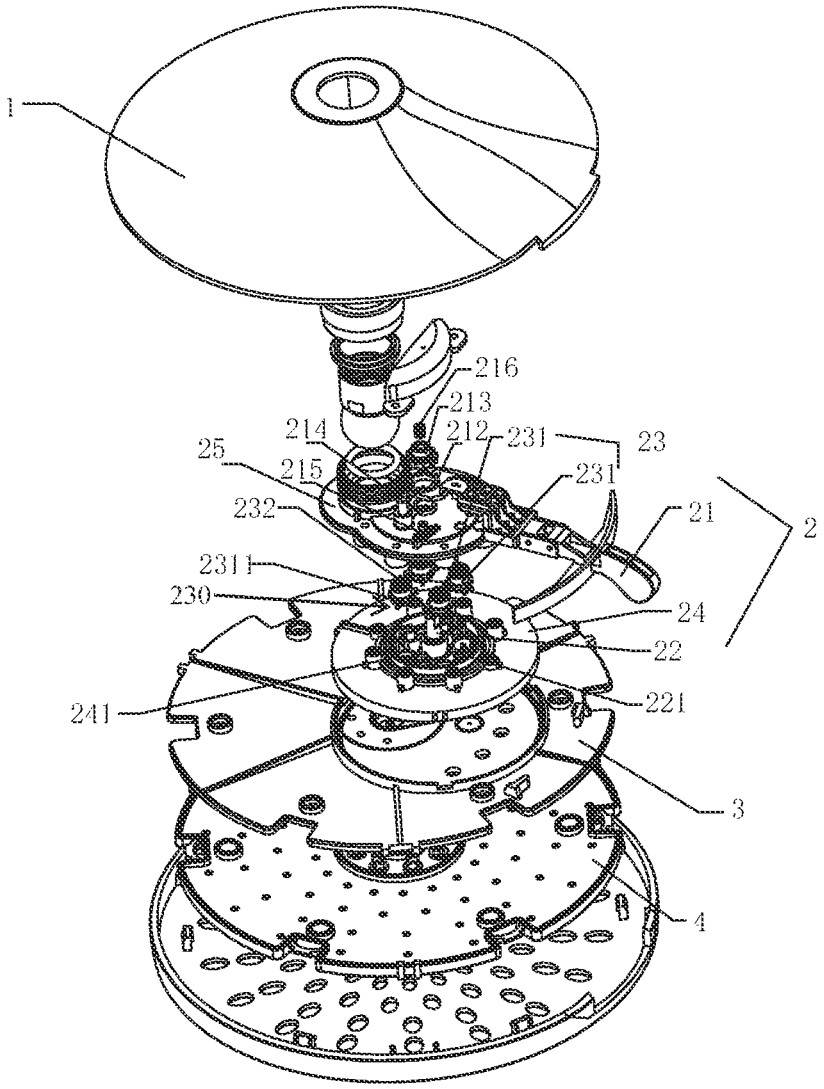
FIG. 1 is a structural exploded view of a showerhead in Embodiment 1 of the present invention.
Figure 2:
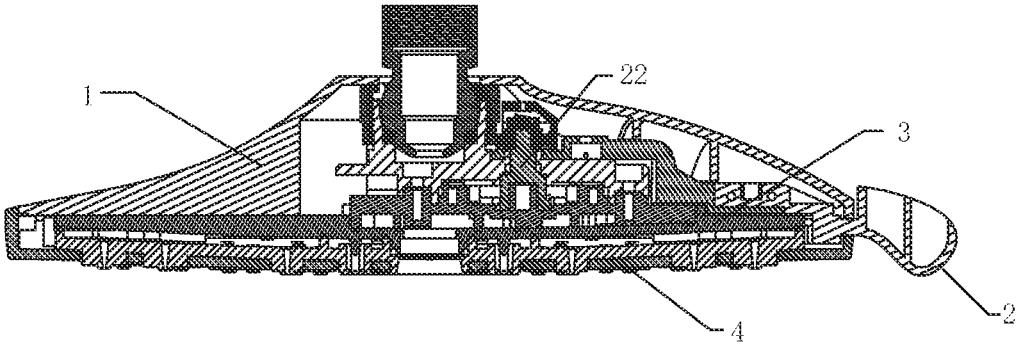
FIG. 2 is a cross-sectional view showing the structure of a showerhead in Embodiment 1 of the present invention.
Figure 3:
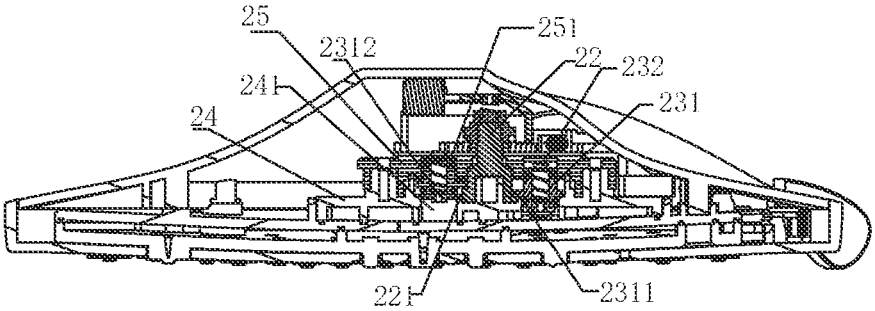
FIG. 3 is a schematic view showing the cooperation of the drive element and the sealing unit in Embodiment 1 of the present invention.

Referring to FIGS. 1-3, the present embodiment provides a showerhead, which comprises a body 1, a switching device 2, a spray seat 3 and a faceplate 4.

The switching device 2 comprises: an operating member 21, a drive element 22, a sealing assembly 23 and a water dividing member 24;

The sealing assembly 23 is disposed above the water dividing member 24 and are spaced apart along the circumferential direction of the water dividing member 24. The sealing assembly 23 include a sealing unit 231 corresponding to the water dividing hole 241 of the water dividing member 24; the drive element 22 is coupled to the operating member 21, and the drive element 22 is disposed with a transmission mechanism 221 coupling with the sealing unit 231; when the operating member 21 drives the drive element 22 to move, the transmission mechanism 221 and the sealing assembly 23 move relative to each other. When the transmission mechanism 221 is moved to be engaged with the sealing unit 231, the sealing unit 231 moves upwardly in the transmission direction generated by the transmission mechanism 221, in the embodiment, the transmission direction generated by the transmission mechanism 221 is the upward direction along the axial direction, so that the sealing unit 231 and the corresponding water dividing hole 241 are separated, the water dividing hole 241 is opened.

Therefore, this embodiment realizes opening or closing the water dividing hole 241 by moving the sealing unit 231 up and down in the axial direction. Each sealing unit 231 correspondingly closes or opens a water dividing hole 241, and the structure is simple and reliable.

The above only describes how the sealing unit 231 opens the water dividing hole 241. In order to close the water dividing hole 241 by the sealing unit 231, in this embodiment, the sealing unit 231 is connected to a resetting member 232; when the sealing unit 231 moves upwardly in the axial direction to open the water dividing hole 241, the resetting member 232 is pressed to store the elastic restoring force. When the transmission mechanism 221 is moved to disengage with the sealing unit 231, the resetting member 232 drives the sealing unit 231 to move in the opposite direction of the transmission direction generated by the transmission mechanism 221, that is, to move downward along the axis of the sealing unit 231, so that the sealing unit 231 abuts against the water dividing hole 241, and the water dividing hole 241 is closed.

Specifically, in order to realize the mounting of the sealing assembly 23, the switching device 2 further comprises a fixing base 25 fixedly connected in the body 1, and one side of the fixing base 25 facing to the water diving member 24 is disposed with an accommodating cavity 251 with the number corresponding to the sealing unit 231. The sealing unit 231 and the resetting member 232 are disposed in the accommodating cavity 251, and the two ends of the resetting member 232 respectively abut against the sealing unit 231 and the cavity bottom of the accommodating cavity 251.

In order to reduce the force to open the water dividing hole 241, the inner diameter of the accommodating cavity 251 is the same as the inner diameter of the water dividing hole 241. Therefore, when the sealing unit 231 is in the closed position, water pressure applied to the upper and lower ends of the sealing unit 231 are equal and opposite in direction, that is, in a state of water pressure balance. Therefore, the opening of the sealing unit 231 only needs to overcome the resetting force of the resetting member 232, the force for the operation is small, and the switching feel is better. In addition, the sealing unit 231 is disposed with a through hole 2312; when the sealing unit 231 is separated from the water dividing hole 241, water flows into the accommodating cavity 251 through the through hole 2312. This ensures that the sealing unit 231 is also in a state of water pressure balance when the sealing unit 231 is in the open position, and only a small resetting force is required to reset the sealing unit 231 to the closed position.

In the embodiment, the showerhead does not have combined spray pattern, that is to say, when the user switches the water pattern by the operating member 21, the water outlet in different areas of the faceplate 4 discharge water corresponding to different operation of the operating member 21, and there is no combined spray pattern. Therefore, in order to achieve the above-described effects, it is necessary for the transmission mechanism 221 to be engaged with only one sealing unit 231 at any time, so that only one of the water dividing holes 241 is in the open state.

In order to achieve such water outlet switching effect, in this embodiment, the transmission mechanism 221 is an inclined surface disposed along the circumferential direction of the drive element 22; the sealing unit 231 is disposed with a matching surface 230, the matching surface 230 defines a protrusion 2311 that abuts against the inclined surface. Specifically, the protrusion 2311 is provided on the side wall of the sealing unit 231 and extends in a direction perpendicular to the axis of the sealing unit 231. In this embodiment, there are five water dividing holes 241, five sealing units 231 and two inclined surfaces. The distance between the two inclined surfaces ensures that only one inclined surfaces of the drive element 22 is coupled with the protrusion 2311 of the sealing unit 231 at any time while the drive element 22 is rotating. Therefore, the operating member 21 drives the drive element 22 to rotate about the axial direction, when the inclined surface is rotated to abut against the lower bottom surface of the protrusion 2311 and the drive element 22 is continuously rotated, the protrusion 2311 moves upwardly along the axis of the seal unit 231 under the driving of the inclined surface, as shown in FIGS. 5-9.

In order to discharge water from the water outlets in different areas of the faceplate 4 when the different water dividing holes 241 is opened, the water outlet body 3 has a multiple of mutually independent water outlet chambers, and each water outlet chamber is correspondingly connected to one of the five water dividing holes 241. Each of the water outlet chambers is correspondingly connected to the water outlet in different areas of the faceplate 4, so that when one of the five water dividing holes 241 is opened, only one water outlet chamber has water flowing, and only the water outlet hole in the area corresponding to the water outlet chamber discharges water. In this way, each time the user operates the operation member 21, the water discharges out in different areas of the faceplate 4, and the water types are different.

As a simple replacement of the embodiment, the number of the water dividing holes 241 may also be four, three or two, as shown in FIGS. 10-13, 14-16, 17-18, respectively. The simple replacement of this embodiment is not described again.

Figure 4:
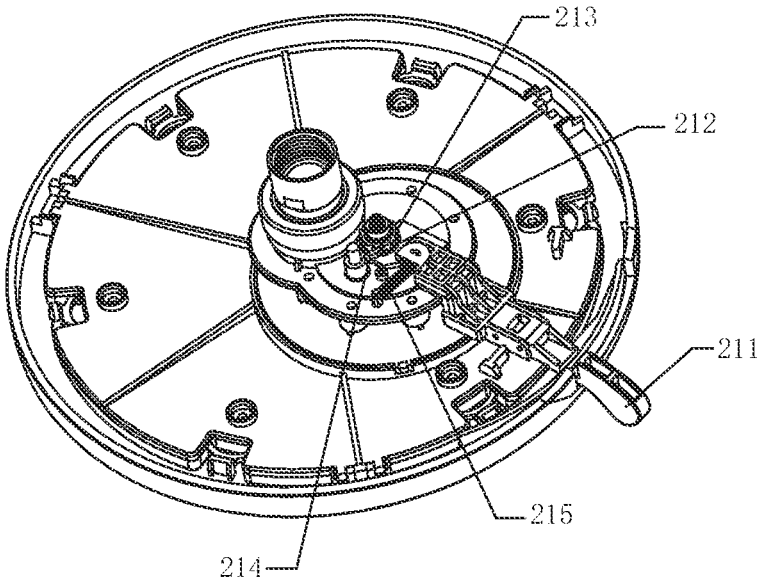
FIG. 4 is a schematic structural view of an operating member in Embodiment 1 of the present invention.
Figure 5:
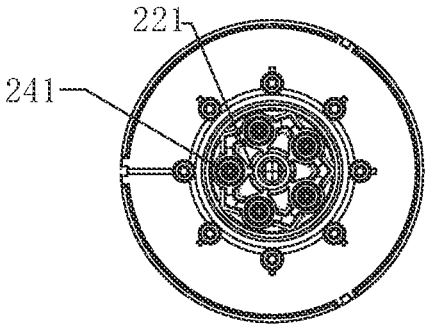
FIGS. 5-9 are top views showing the cooperation of the drive element, the sealing assembly and the water dividing hole when there are five water dividing holes in Embodiment 1 of the present invention.
Figure 6:
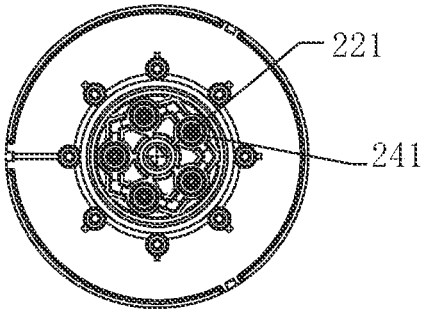
Figure 7:
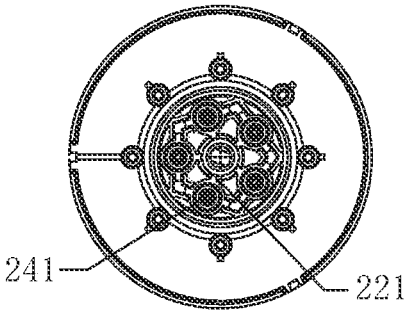
Figure 8:
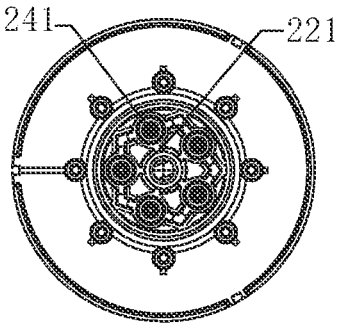
Figure 9:
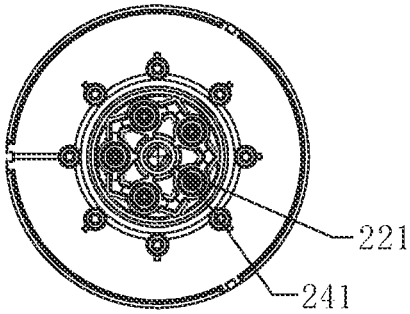
Figure 10:
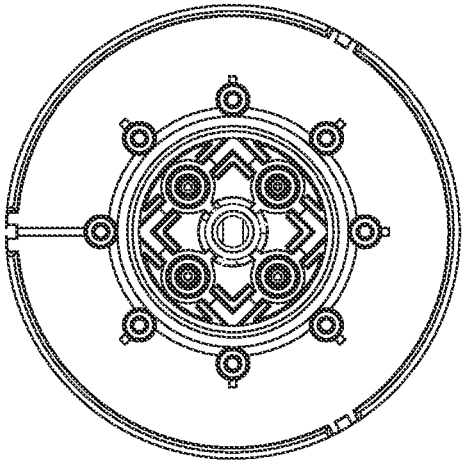
FIGS. 10-13 are top views showing the cooperation of the drive element, the sealing assembly and the water dividing hole when there are four water dividing holes in Embodiment 1 of the present invention.
Figure 11:
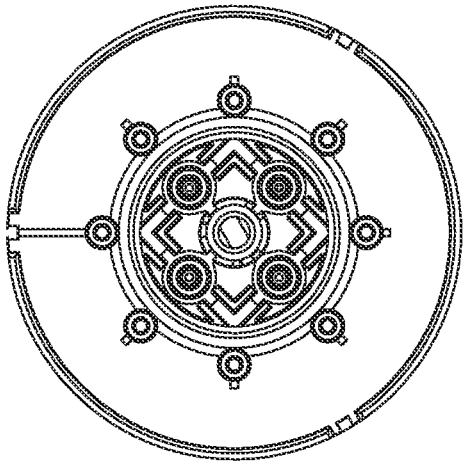
Figure 12:
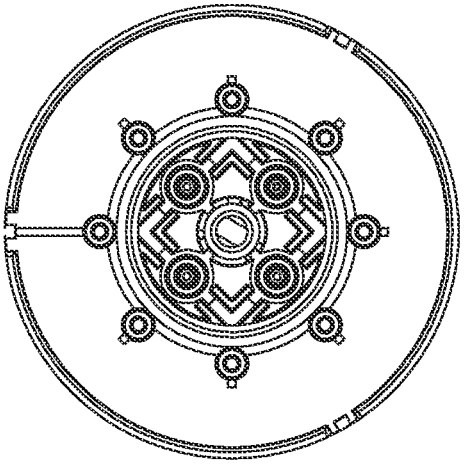
Figure 13:
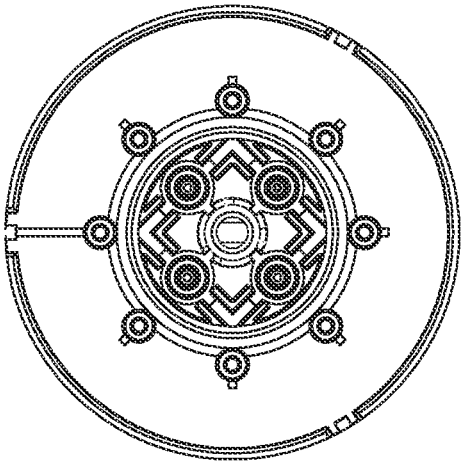
Figure 14:
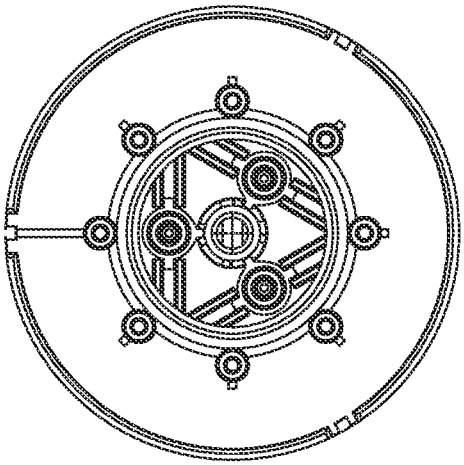
FIGS. 14-16 are top views of the cooperation of the drive element, the sealing assembly and the water dividing hole when there are three water dividing holes in Embodiment 1 of the present invention.
Figure 15:
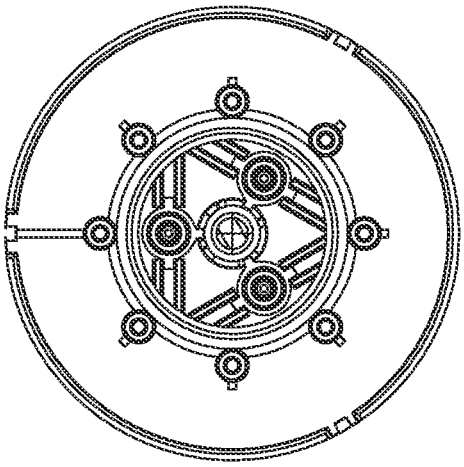
Figure 16:
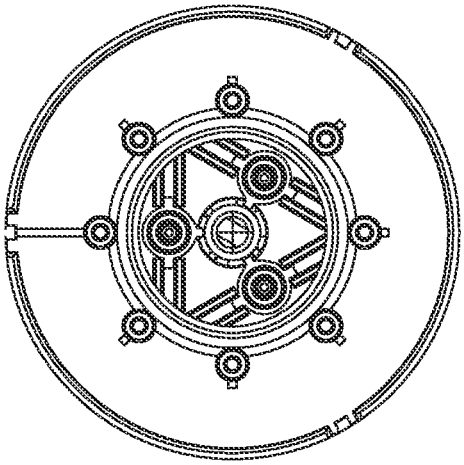
Figure 17:
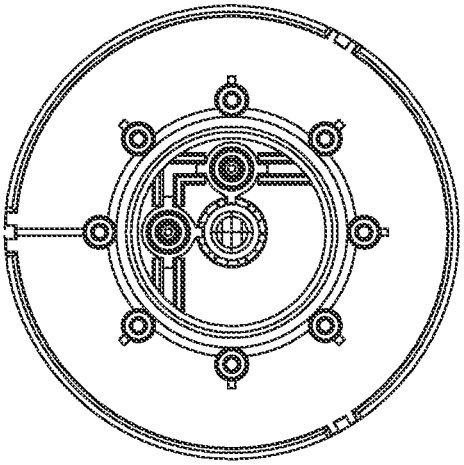
FIGS. 17-18 are top views of the drive element, the sealing assembly and the water dividing hole when there are two water dividing holes in Embodiment 1 of the present invention.
Figure 18:
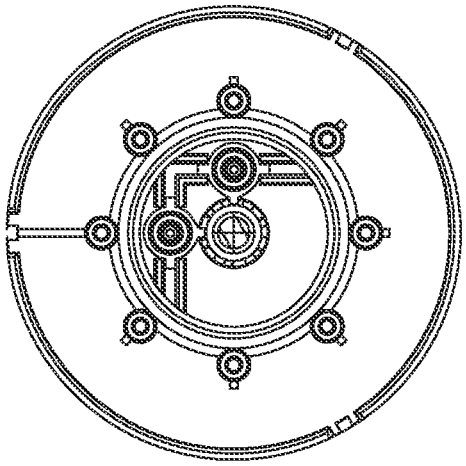
Figure 19:
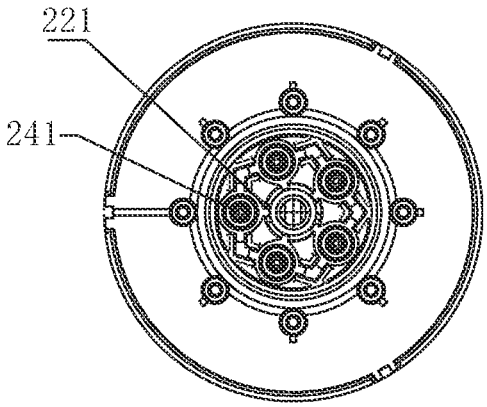
FIGS. 19-23 are top views of the cooperation of the drive element, the sealing assembly and the water dividing hole when there are five water dividing holes in Embodiment 2 of the present invention.
Figure 20:
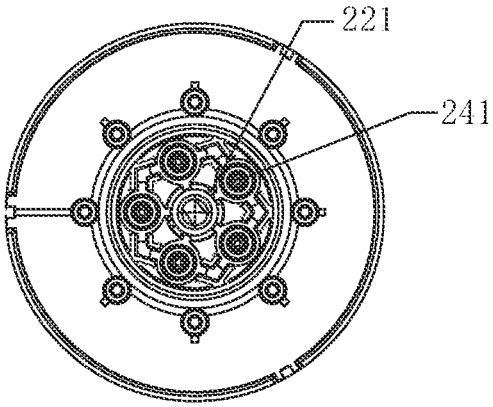
Figure 21:
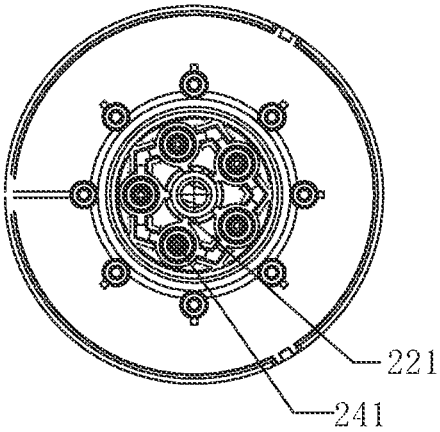
Figure 22:
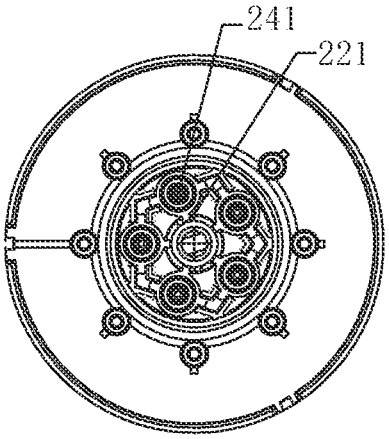
Figure 23:
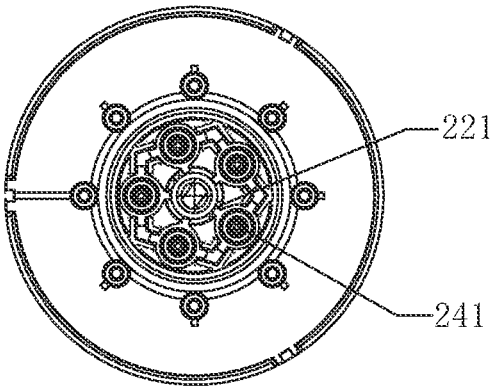
Figure 24:
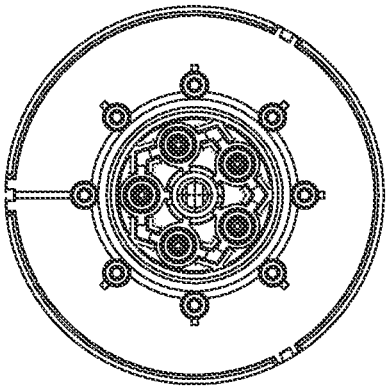
FIGS. 24-28 are top views of the fitting member, the sealing assembly and the water dividing hole when there are five water dividing holes in Embodiment 3 of the present invention.
Figure 25:
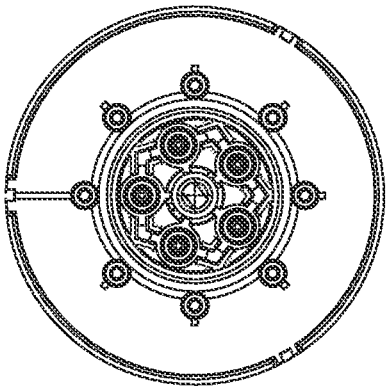
Figure 26:
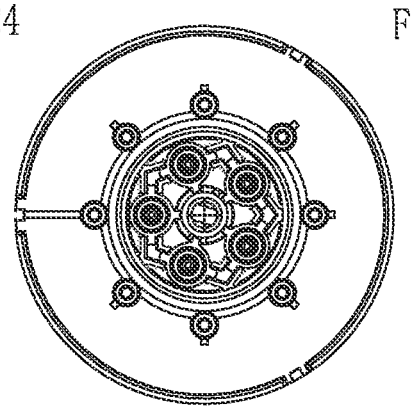
Figure 27:
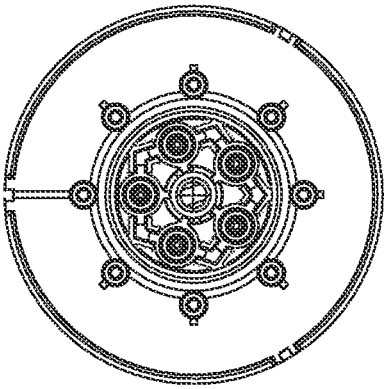
Figure 28:
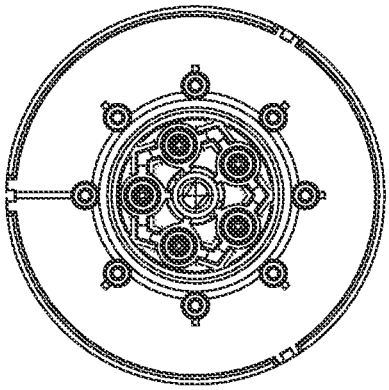
Figure 29:
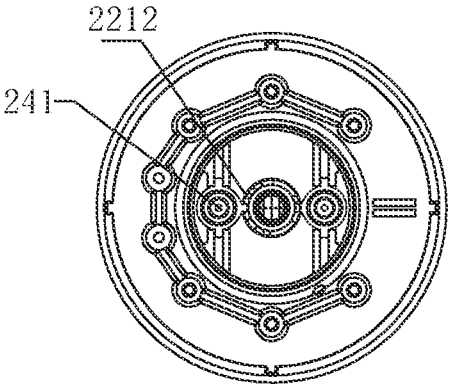
FIGS. 29-33 are top views of the cooperation of the drive element, the sealing assembly and the water dividing hole when there are two water dividing holes in Embodiment 4 of the present invention.
Figure 30:
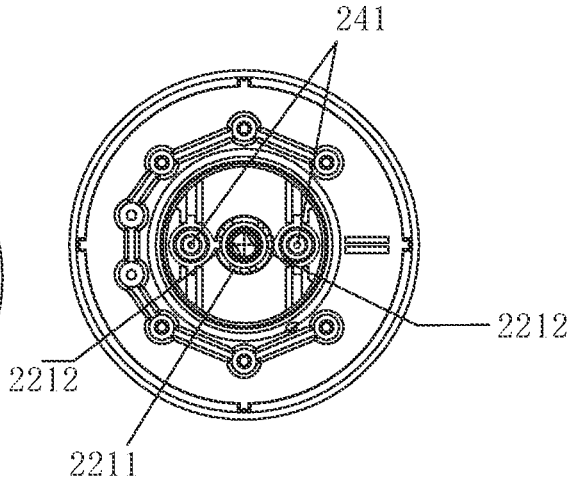
Figure 31:
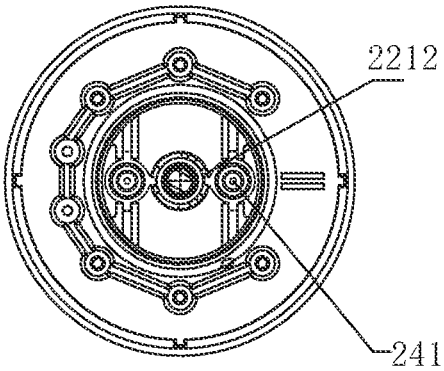
Figure 32:
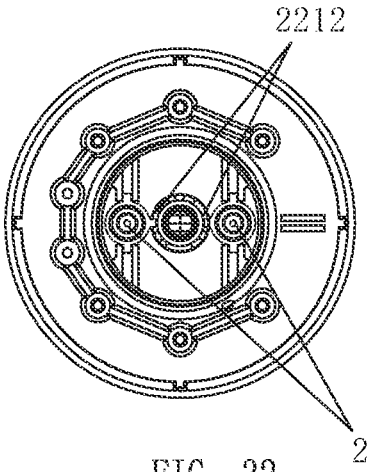
Figure 33:
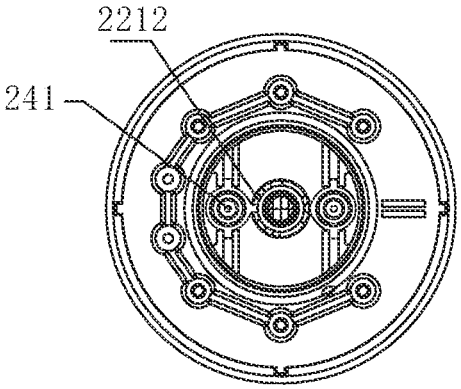

With reference to FIG. 4, in this embodiment, the operating member 21 comprises a dial 211, a driving wheel 212, a driven wheel 213, a rotation preventing mechanism 214, a first reset mechanism 215, and a second reset mechanism 216;

One end of the dial 211 is located outside the body 1 and the other end is inserted to the body 1 and is linked to the driving wheel 212. When the user pushes the dial 211 clockwise or counterclockwise, the driving wheel 212 also rotates clockwise or counterclockwise. One end of the first reset mechanism 215 is a fixed end, and the other end is linked to the dial 211, so that when the dial 211 is reversely pushed, the reset mechanism 215 is extracted to store an elastic restoring force, after the operation of the user, the dial 211 will rotate clockwise under the elastic restoring force to return to the initial position.

In order to realize the rotation of the drive element 22 about its own axial direction, in this embodiment, the driving wheel 212 and the driven wheel 213 are coaxially linked, and the driven wheel 213 is linked to the drive element 22. Thus, when the operating member 21 drives the driven wheel 213 to rotate in the counterclockwise direction by the driving wheel 212, the drive element 22 rotates about its own axis under the driving of the driven wheel 213. The reset mechanism 216 is abutted between the body and the driven wheel 213. When the dial 211 is rotated in the clockwise direction, the driven wheel 213 is disengaged with the driving wheel 212, and the driven wheel 213 moves upwardly under the action of the reset force of the driving wheel 212 and the rotation stop mechanism After the driving wheel 212 is reset, the driven wheel 213 is moved down by the second reset mechanism 216 and is engaged with the driving wheel 212. This prevents the drive element 22 from being reset accordingly. Thereby, once the dial is toggled, the drive element is rotated by a certain angle in the counterclockwise direction, and the water outlet also completes a gear change.

In order to achieve unidirecitonal interlocking engagement of the driving wheel 212 and the driven wheel 213 in the counterclockwise direction, the rotation stop mechanism 214 is a pawl; the side wall of the driven wheel 213 is provided with a ratchet. The unidirectional interlocking is achieved by the pawl and the ratchet. The resetting member 232 is a spring.

Embodiment 2

Referring to FIGS. 19-23, the difference between this embodiment and Embodiment 1 is that there is one water dividing hole 241 connected to the two water outlet chambers, so that when the water dividing hole 241 is opened, the two water outlet chambers connected to it have water flowing and forming a mixed water outlet. The remaining four water dividing holes 241 are still connected to only one water outlet chamber, which is the same as that of Embodiment 1, and will not be described again.

If more mixed water types are needed, it just connects some water holes 241 to the two water outlet chambers. One of the water dividing holes 241 may be a blind hole, and when the sealing unit 231 is away from the blind hole, the water is stopped.

Embodiment 3

Referring to FIGS. 24-28, the difference between this embodiment and Embodiment 2 is that there is one water dividing hole 241 connected to three water outlet chambers, so that when the water dividing hole 241 is opened, the three water outlet chambers connected to it have water flowing and forming a mixed water outlet. The remaining four water dividing holes 241 are still connected to only one water outlet chamber, which is the same as that of Embodiment 1, and will not be described again. If more mixed types are needed, it just connects some water holes 241 to the three water outlet chambers.

Embodiment 4

Referring to FIGS. 29-33, the difference between this embodiment and Embodiment 1 is that there are two water dividing holes 241, and the transmission mechanism 221 is in a driving engagement with at least two sealing units 231 at a certain time, so that the two water dividing holes 241 are simultaneously open. Therefore, at this time, there is water in the two water outlet chambers in the water outlet body 3, and the effect of mixing the water can be achieved.

Figure 34:
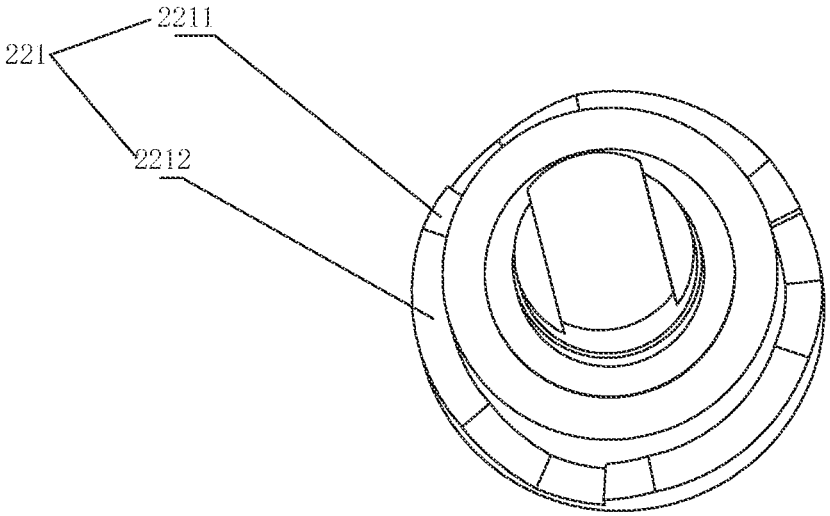
FIG. 34 is a structural view showing the transmission mechanism in Embodiment 4 of the present invention.
Figure 35:
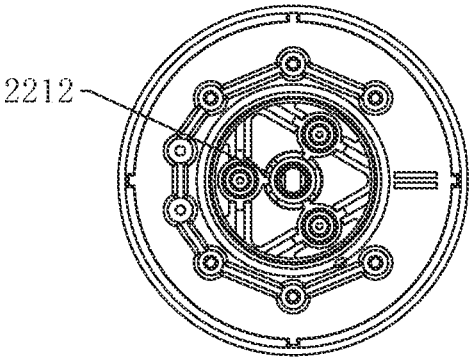
FIGS. 35-41 are top views of the cooperation of the drive element, the sealing assembly and the water dividing hole when there are three water dividing holes in Embodiment 5 of the present invention.
Figure 36:
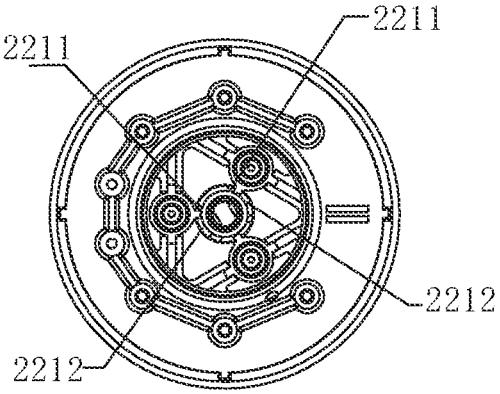
Figure 37:
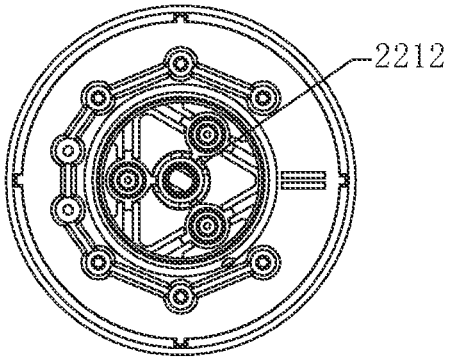
Figure 38:
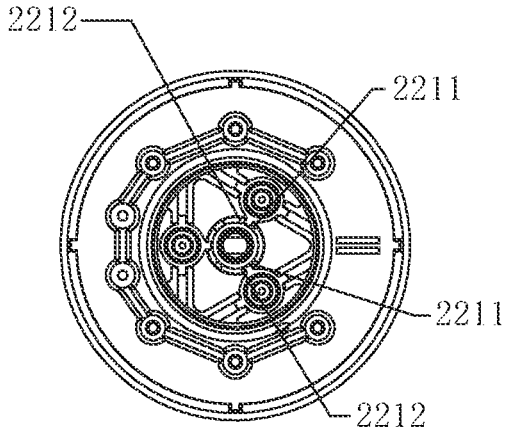
Figure 39:
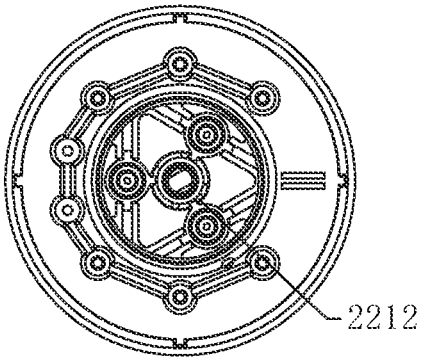
Figure 40:
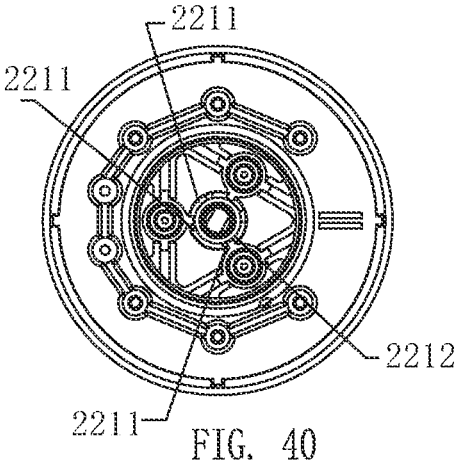
Figure 41:
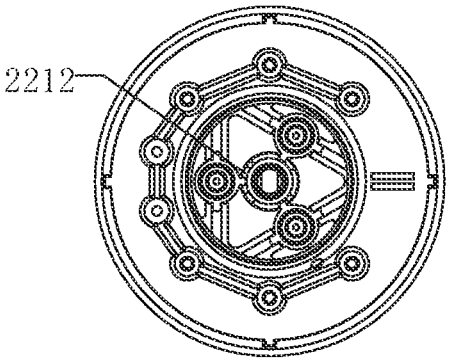
Figure 42:
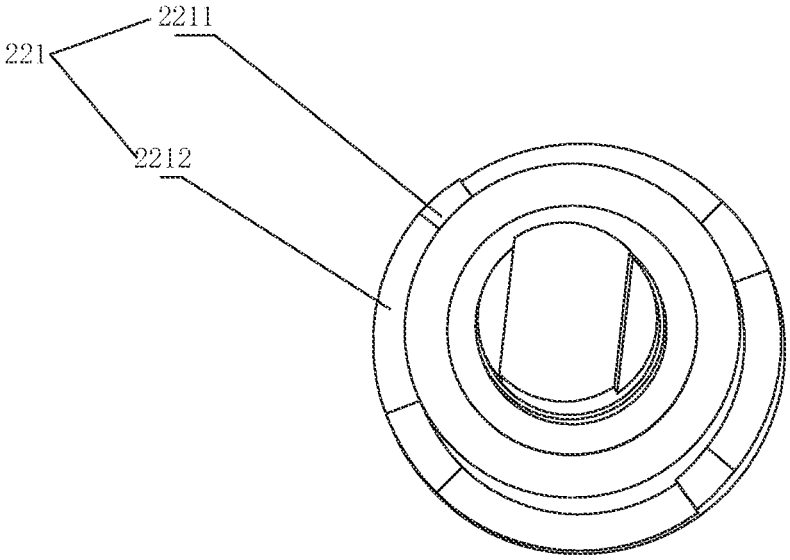
FIG. 42 is a structural view showing the transmission mechanism in Embodiment 5 of the present invention.

In order to achieve the above effect, the transmission mechanism 221 comprises two mirrored inclined surfaces 2211 and a horizontal surface 2212 connected between the highest points of the two inclined surfaces 2211, and three transmission mechanisms are disposed with interval along the circumferential direction of the drive element 22; the sealing unit 231 is disposed with a protrusion that abuts against the inclined surface, as shown in FIG. 34;

The operating member 21 drives the drive element 22 to rotate about the axial direction. When the inclined surface 2211 is rotated to abut against the protrusion, the inclined surface 2211 drives the protrusion to move upward along the axial direction; when the horizontal surface 2212 rotates to abut against the protrusion, the water dividing hole 241 is kept open. When the two sealing units 231 simultaneously abut against the inclined surface 2211 or the horizontal surface 2212 of the transmission mechanism 221, the two water dividing holes are simultaneously opened.

Therefore, the distance between the three transmission mechanisms 221 needs to be satisfied that when the first water dividing hole 241 is opened, the second water dividing hole 241 is closed, the first and second water dividing holes are simultaneously opened, when the first water dividing hole 241 is closed, the second water dividing holes 241 is opened, the first and second water dividing holes are simultaneously opened, and when the first water dividing hole 241 is opened, the second water dividing hole 241 is closed, such a switching process.

Embodiment 5

Referring to FIGS. 35-42, the difference between this embodiment and Embodiment 4 is that there are three water dividing holes 241 and two transmission mechanisms 221. Each of the transmission mechanisms also comprises an inclined surface 2211 and a horizontal surface 2212 that is coupled to the highest point of the inclined surface 2211. The transmission mechanism 221 is in transmission engagement with at least two sealing units 231 at a certain time, that is, one of the sealing units 231 abuts against the inclined surface 2211 or the horizontal surface 2212 of one transmission mechanism 221, and the other sealing unit 231 abuts against the inclined surface 2211 or the horizontal surface 2212 of the other transmission mechanism 221, so that the two water dividing holes 241 are simultaneously opened. Therefore, at this time, there is water in the two water outlet chambers in the water outlet body 3, and the effect of mixing the water can be achieved.

The operating member 21 drives the drive element 22 to rotate about the axial direction. When the inclined surface 2211 is rotated to abut against the protrusion, the inclined surface 2211 drives the protrusion to move upward along the axial direction; when the horizontal surface 2212 rotates to abut against the protrusion, the water dividing hole 241 is kept open. Therefore, the distance between the two transmission mechanisms 221 needs to be satisfied that when the first water dividing hole 241 is opened, the second and third water dividing holes 241 are closed, when the first and second water dividing holes are simultaneously opened, the third water dividing holes 241 is closed, when the first and third water dividing holes 241 are closed, the second water dividing hole is opened, when the first water dividing hole 241 is closed, the second and third water dividing holes 241 are simultaneously opened, when the third water dividing hole 241 is opened, the first and second water dividing holes 241 are closed; when the third and the first water dividing hole 241 are opened, the second water dividing hole 241 is closed, and when the first water dividing hole 241 is opened, the second and third water dividing holes 241 are closed, such a switching process.

Although the present invention is disposed with been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A switching device, comprising:

a drive element, a sealing assembly, a fixed base, and a water dividing member comprising one or more water dividing holes, wherein:

the sealing assembly is disposed above the water dividing member and separately disposed along a circumference direction of the water dividing member, the sealing assembly comprises one or more sealing units corresponding to the one or more water dividing holes one to one, the one or more sealing units comprise one or more sealing surfaces, the drive element is disposed with a transmission surface configured to be interlocked to the one or more sealing units, a side of the fixed base facing the water dividing member is disposed with one or more accommodating cavities, the number of the one or more accommodating cavities corresponds to the number of the one or more sealing units, the one or more sealing units are disposed with through holes enabling the one or more accommodating cavities to be in communication with external sides of the one or more accommodating cavities, side walls of the one or more sealing units are disposed with one or more matching surfaces configured to abut the transmission surface, and when the drive element moves:

the transmission surface moves to be interlocked to and engaged with one of the one or more sealing units, a corresponding one of the one or more matching surfaces moves along the transmission surface to enable the one of the one or more sealing surfaces to be separated from a corresponding one of the one or more water dividing holes, the corresponding one of the one or more water dividing holes is opened, and water flows into the one or more accommodating cavities through the one or more through holes.

2. The switching device according to claim 1, wherein:

the one or more sealing units are connected to one or more resetting members, when the drive element moves to be disengaged from the one or more sealing units:

the one or more resetting members drive the one or more sealing units to move in an opposite direction of a movement direction of the one or more sealing units due to the transmission surface to enable the one or more sealing surfaces to abut the corresponding one of the one or more water dividing holes, and the corresponding one of the one or more water dividing holes is closed.

3. The switching device according to claim 2, comprising:

a fixing base configured to be disposed with the one or more sealing units, wherein:

the one or more sealing units and the one or more resetting members are disposed in the one or more accommodating cavities, and two ends of the one or more resetting members respectively abut the one or more sealing units and cavity bottoms of the one or more accommodating cavities.

4. The switching device according to claim 3, wherein:

inner diameters of the one or more accommodating cavities are the same as inner diameters of the one or more water dividing holes.

5. The switching device according to claim 1, wherein the transmission surface is only interlocked to and cooperates with one of the one or more sealing units at any time, so that only one of the one or more water dividing holes is open.

6. The switching device according to claim 5, comprising:

an operating member, wherein:

the drive element is interlocked to the operating member, the transmission surface comprises an inclined surface and is disposed along a circumferential direction of the drive element, the one or more matching surfaces define one or more protrusions and are configured to abut the inclined surface, the operating member drives the drive element to rotate about an axial direction of the drive element, and when the inclined surface rotates to abut the one or more matching surfaces, the inclined surface drives the one or more matching surfaces to move upward in the axial direction.

7. The switching device according to claim 5, wherein further comprising:

a water outlet body, wherein:

the water outlet body is disposed with mutually independent water outlet chambers, and each of the mutually independent water outlet chambers is correspondingly in communication with one of the one or more water dividing holes.

8. The switching device according to claim 5, comprising:

a water outlet body, wherein:

the water outlet body is disposed with mutually independent water outlet chambers, at least one of the one or more water dividing holes is in communication with at least two of the mutually independent water outlet chambers, and when the at least one of the one or more water dividing holes is opened, water flows into the at least two of the mutually independent water outlet chambers in communication with the at least one of the one or more water dividing holes to form mixed spray water.

9. The switching device according to claim 1, wherein the transmission surface is interlocked to and cooperates with at least two of the one or more sealing units at a certain time, so that at least two of the one or more water dividing holes are open at a same time.

10. The switching device according to claim 9, comprising:

an operating member, wherein:

the drive element is interlocked to the operating member, the transmission surface comprises one or more inclined surfaces and one or more horizontal surfaces connected to highest points of the one or more inclined surfaces, the one or more inclined surfaces and the one or more horizontal surfaces are separately disposed along a circumferential direction of the drive element, the one or more sealing units are disposed with one or more matching surfaces configured to abut the one or more inclined surfaces, the operating member drives the drive element to rotate about an axial direction of the drive element, when the one or more inclined surfaces rotate to abut the one or more matching surfaces, the one or more inclined surfaces drive the one or more matching surfaces to move upward along the axial direction of the drive element, and when the one or more horizontal surfaces rotate to abut the one or more matching surfaces, the at least two of the one or more water dividing holes remain open.

11. The switching device according to claim 9, comprising:

a water outlet body, wherein:

the water outlet body is disposed with mutually independent water outlet chambers, and each of the mutually independent water outlet chambers corresponds to one of the one or more water dividing holes.

12. The switching device according to claim 1, comprising:

an operating member, wherein:

the operating member comprises a dial, a driving wheel, a driven wheel, and a rotating stop mechanism, and a reset mechanism, the driven wheel is rotated by the driving wheel, the reset mechanism enables the driving wheel to be interlocked to and cooperate with the driven wheel unidirectionally, the driven wheel is interlocked to the drive element, and when the driving wheel is reset by a resetting force of the reset mechanism, the driven wheel is disengaged from the driving wheel.

13. The switching device according to claim 12, wherein:

the rotating stop mechanism comprises a pawl, a side wall of the driven wheel is provided with a ratchet wheel, the reset mechanism comprises a spring, and when the dial is pushed, the spring is stretched to store an elastic restoring force due to a tensile force.

14. A top shower comprising a switching device according to claim 1.

* * * * *